US005085270A

United States Patent [19]

Counterman et al.

[11] Patent Number: 5,085,270

[45] Date of Patent: Feb. 4, 1992

[54] DUAL ANGLE HEAT PIPE AIR PREHEATER

[75] Inventors: Wayne S. Counterman, Wellsville; Thomas G. Mergler, Bolivar, both of N.Y.

[73] Assignee: ABB Air Preheater, Inc., Wellsville, N.Y.

[21] Appl. No.: 632,267

[22] Filed: Dec. 21, 1990

[51] Int. Cl.[5] ..... F28G 9/00; F28D 15/02

[52] U.S. Cl. ..... 165/95; 165/104.14

[58] Field of Search ..... 165/104.14, 95

[56] References Cited

FOREIGN PATENT DOCUMENTS

| | | | |
|---|---|---|---|
| 61596 | 5/1981 | Japan | 165/104.14 |
| 31290 | 2/1983 | Japan | 165/104.14 |
| 264655 | 6/1970 | U.S.S.R. | 165/104.14 |
| 637614 | 12/1978 | U.S.S.R. | 165/104.14 |
| 1265454 | 10/1986 | U.S.S.R. | 165/104.14 |
| 18365 | of 1894 | United Kingdom | 165/104.14 |
| 767085 | 1/1957 | United Kingdom | 165/104.14 |

*Primary Examiner*—Albert W. Davis, Jr.
*Attorney, Agent, or Firm*—Paul J. Lerner

[57] ABSTRACT

A heat pipe air preheater includes a multiplicity of heat pipes arranged in a plurality of superposed planar rows inclined relative to the horizontal, the rows of heat pipes including a first group of rows inclined at a first inclination angle and a second group inclined at a second inclination angle. Means are provided for removing collections of soot or other particulate matter from the evaporator ends of the heat pipes, the rows of the first group being disposed on one side of these means while the rows of the second group are disposed on the other side, the rows of the two groups converging in the direction of the heat pipe condenser ends.

4 Claims, 2 Drawing Sheets

DUAL ANGLE HEAT PIPE AIR PREHEATER

BACKGROUND AND SUMMARY OF THE INVENTION

The present invention pertains to heat transfer devices and, more particularly, to heat pipe air preheaters used in large-scale industrial processes, such as steam generation for electric generating plants.

Heat pipe air preheaters essentially consist of a bundle of self-contained heat pipes. Each heat pipe is partially filled with a working fluid, most commonly water or hydrocarbon, and sealed. Heat from, for example, flue gas evaporates the working fluid collected in the lower or evaporator end of the slightly inclined pipe (generally 5 to 15 degrees from the horizontal) and the vapor flows to the upper or condenser end, where it gives up heat to the, for example, incoming combustion air.

Condensed fluid returns by gravity to the evaporator end. The process continues indefinitely as long as there exists a temperature difference between the, in this example, flue gas and combustion air. The capacity of the individual heat pipe depends upon several factors, including its inclination angle and the temperature differential between its ends, increasing both as the inclination angle and the temperature differential increase.

In a typical design, heat pipes are attached at their midpoints to a divider plate which both supports the pipes and provides a barrier between the counterflowing flue gas and combustion air. The individual heat pipes are arranged in parallel, superposed rows. On one side of the divider plate, flue gas flows through the rows in one direction, transferring heat to the evaporator ends of the heat pipes, while on the other side of the plate combustion air flows through the rows, most commonly in the opposite direction, absorbing heat from the condenser ends of the pipes. Thus, the temperature differential of the heat pipes in rows at one end of the preheater differs from that of pipes in rows at the opposite end of the preheater. This, in turn, results in the heat pipes of at least some of the rows operating at less than optimal capacity.

Typically, also, heat pipe air preheaters are subject to severe space constraints. The problems thus imposed are compounded by the length of the heat pipes, which is commonly 40 feet or more. Thus, increasing the inclination angle by just one degree results in an increase in the overall height of the air preheater of more than 8 inches.

It is, therefore, a primary object of the present invention to provide a heat pipe air preheater wherein all of the individual heat pipes are operating at optimal capacity.

It is a further object to provide such an air preheater which has a minimal height.

The foregoing and other objects and advantages are achieved by a heat pipe air preheater wherein a multiplicity of heat pipes are arranged in a plurality of superposed, planar rows inclined relative to the horizontal, the rows of heat pipes including a first group of rows inclined at a first inclination angle and a second group inclined at a second inclination angle.

More particularly, the air preheater includes means for removing collections of soot or other particulate matter from the evaporator ends of the heat pipes, and the rows of the first group are disposed on one side of these means while the rows of the second group are disposed on the other side, the rows of the two groups converging in the direction of the heat pipe condenser ends.

DETAILED DESCRIPTION OF THE PREFERRED EMBODIMENT

Figure 1:
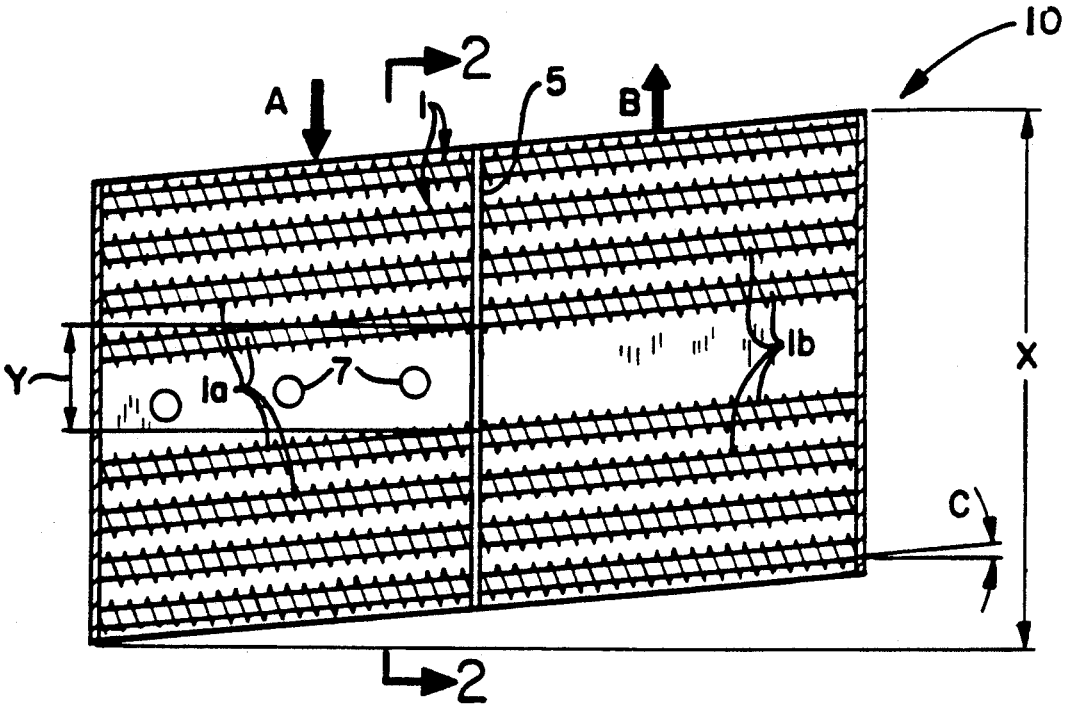
Fig. 1 (PRIOR ART)
FIG. 1 is a side view of a conventional heat pipe air preheater.

Turning now to the drawings, there is shown in FIG. 1, a conventional heat pipe air preheater 10 comprising a multiplicity of finned heat pipes 1 arranged in a plurality of parallel, superposed rows 3. A divider plate 5 supports heat pipes 1 at their midpoints and provides a barrier between the counterflowing flue gas A and combustion air B.

Heat pipes 1 each include an evaporator end 1*a* and a condenser end 1*b*. On the left side of divider plate 5, flue gas flows downwardly through rows 3, transferring heat to evaporator ends 1*a* of heat pipes 1, while on the right side of plate 5, combustion air flows upwardly through rows 3, absorbing heat from condenser ends 1*b* of heat pipes 1. It should be appreciated that the temperature differential, i.e., the difference in temperature between the flue gas at evaporator end 1*a* and the combustion air at the corresponding condenser end 1*b*, is greater for those heat pipes in the lowermost rows than for those in the lowermost rows. Thus, the heat pipes in the uppermost rows are operating at a higher capacity than the pipes in the uppermost rows.

A soot blower 7, which may conventionally comprise a pipe arrangement for intermittently directing an oscillating air or steam stream against evaporator ends 1*a* of heat pipes 1, is provided to remove soot or other particulate matter which may collect thereon. Soot blower 7 is disposed in the flue, intermediate two of the lower rows 3 of heat pipes 1.

Heat pipes I, which are typically 40 feet in length, are inclined at an angle C of, in this example, 7°. If inclination angle C is increased to 10°, so as to increase the capacity of the pipes in the lower rows, it will be appreciated that the overall height of the preheater, identified as X in FIG. 1, will increase by approximately 25 inches.

Figure 3:
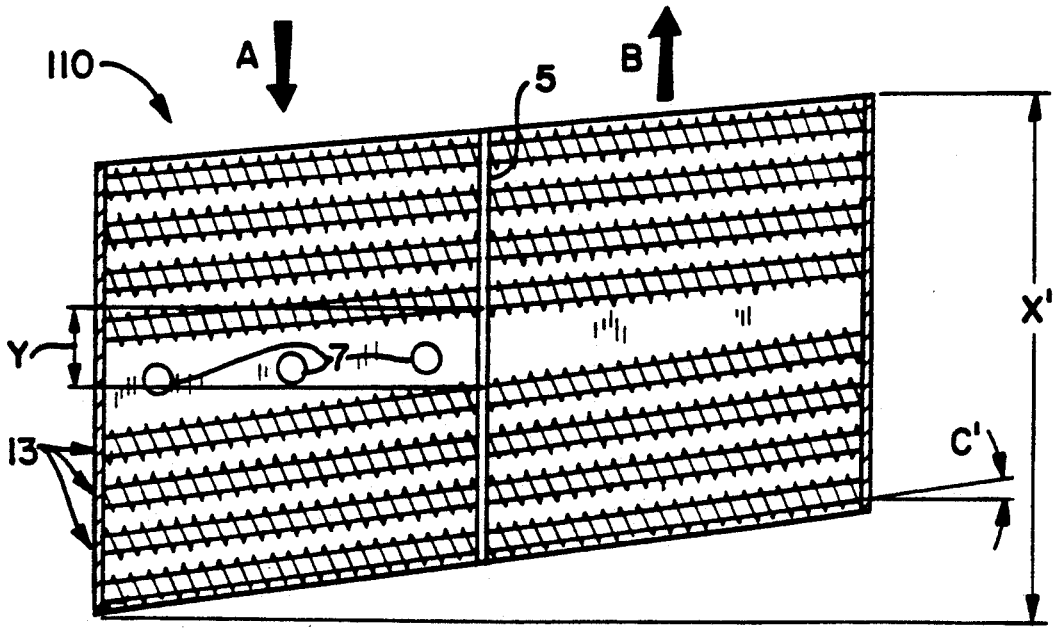
FIG. 3 is a side view of a heat pipe air preheater arranged in accord with the present invention.
Figure 2:
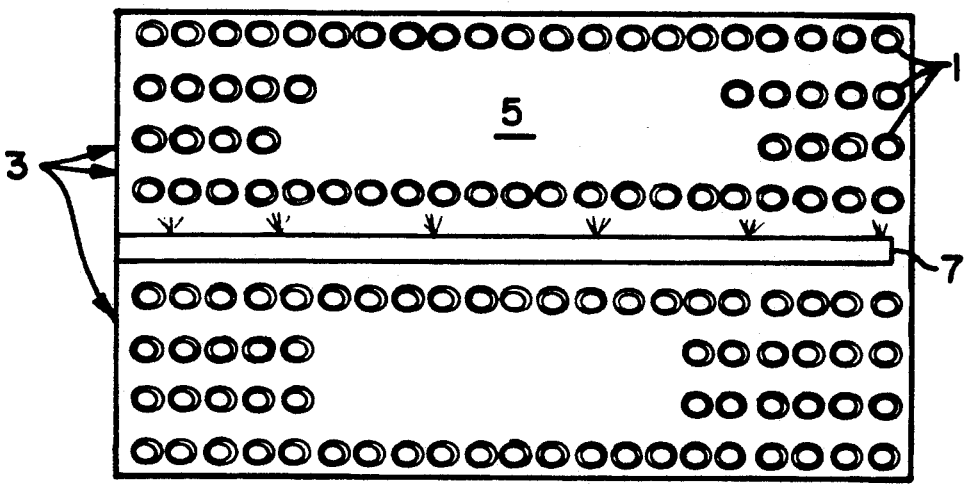
FIG. 2 is a cross-sectional view taken along Line 2—2 of FIG. 1.

Turning now to FIG. 3, there is shown an air preheater 110 arranged in accord with the present invention. Air preheater 110 differs from air preheater 10 in that the lowermost rows 13 of heat pipes 1, i.e., those below soot blower 7, are inclined at an angle C′ of 10°, having been rotated about the point where they pass through divider plate 5. Heat pipes of lowermost rows 13 thus converge with heat pipes 1 in uppermost rows 3 in the direction of heat pipe condenser ends 1*b*.

The increased inclination of lowermost rows 13 results in an increase in the heat carrying capacity of the heat pipes 1 therein. The overall height X′ of air preheater 110 is, however, only approximately 12.5 inches greater than overall height X of air preheater 10. Thus, one half of the height increase heretofore resulting from an increase in the angle of inclination has been avoided. At the same time, however, the minimum clearance Y for soot blower 7 has remained unchanged.

We claim:

1. An improved heat pipe heat transfer device, of the type comprising a multiplicity of heat pipes and soot blower means for removing particulate matter which may collect thereon, said heat pipes each having a condenser end and an evaporator end, said heat pipes being arranged in a plurality of superposed planar rows inclined relative to the horizontal, with said condenser ends being elevated relative to said evaporator ends; the improvement comprising:

said rows of heat pipes including a first group of rows inclined at a first absolute inclination and a second group of rows inclined at a second absolute inclination angle, said soot blower means being disposed between said first group of rows and said second group of rows.

2. An improved heat pipe heat transfer device, of the type comprising a multiplicity of heat pipes each having a condenser end and an evaporator end, said heat pipes being arranged in a plurality of superposed planar rows inclined relative to the horizontal, with said condenser ends being elevated relative to said evaporator ends; the improvement comprising:

said rows of heat pipes including a first group of rows inclined at a first inclination angle and a second group of rows inclined at a second inclination angle, said evaporator ends of said heat pipes being exposed to a flow of heated fluid and said condenser ends being exposed to a flow of fluid to be heated, said first group being upstream of said second group with respect to said flow of heated fluid and downstream of said second group with respect to said flow of fluid to be heated, and said second inclination angle is greater than said first inclination angle.

3. The heat pipe heat transfer device of claim 2, wherein said first inclination is approximately 7° and said second inclination angle is approximately 10°.

4. An improved heat pipe heat transfer device, of the type comprising a multiplicity of heat pipes each having a condenser end and an evaporator end, said heat pipes being arranged in a plurality of superposed planar rows inclined relative to the horizontal, with said condenser ends being elevated relative to said evaporator ends; the improvement comprising:

said rows of heat pipes including a first group of rows inclined at a first inclination angle and a second group of rows inclined at a second inclination angle; and means, disposed between said evaporator ends of said heat pipes of said first group of rows and those of said second group, for removing collections of soot or other particulate matter which may collect on said evaporator ends of said heat pipes, said rows of said two groups converging in the direction of said heat pipe condenser ends.

* * * * *